US007294043B2

(12) United States Patent
Chen et al.

(10) Patent No.: US 7,294,043 B2
(45) Date of Patent: Nov. 13, 2007

(54) CMP APPARATUS AND PROCESS SEQUENCE METHOD

(75) Inventors: Chen-Shien Chen, Hsin-Chu (TW); Yai-Yei Huang, Hsin-Chu (TW); Ming-Hsiang Kao, Tainan (TW); Yih-Shung Lin, Sanchung (TW); Winata Karta Tjandra, Hsinchu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 0 days.

(21) Appl. No.: 11/470,407

(22) Filed: Sep. 6, 2006

(65) Prior Publication Data

US 2007/0021038 A1 Jan. 25, 2007

Related U.S. Application Data

(62) Division of application No. 10/788,702, filed on Feb. 27, 2004, now Pat. No. 7,118,451.

(51) Int. Cl.
*B24B 49/00* (2006.01)

(52) U.S. Cl. ..... 451/41; 451/28

(58) Field of Classification Search ..... 451/41, 451/28, 5–10, 285–288, 63, 11
See application file for complete search history.

(56) References Cited

U.S. PATENT DOCUMENTS

| | | | | |
|---|---|---|---|---|
| 6,623,333 | B1 | 9/2003 | Patel et al. | |
| 6,976,907 | B2 * | 12/2005 | Golzarian et al. | 451/56 |
| 7,118,451 | B2 * | 10/2006 | Chen et al. | 451/8 |
| 2004/0166785 | A1 * | 8/2004 | Golzarian et al. | 451/56 |
| 2005/0191942 | A1 * | 9/2005 | Chen et al. | 451/5 |
| 2007/0021038 | A1 * | 1/2007 | Chen et al. | 451/8 |

OTHER PUBLICATIONS

China Office Action mailed Sep. 29, 2006.

* cited by examiner

*Primary Examiner*—Lee D. Wilson
(74) *Attorney, Agent, or Firm*—Thomas, Kayden, Horstemeyer & Risley

(57) ABSTRACT

A CMP apparatus and process sequence. The CMP apparatus includes multiple polishing pads or belts and an in-line metrology tool which is interposed between adjacent polishing pads or belts in the apparatus. A material layer on each of multiple wafers is successively polished on the polishing pads or belts. The metrology tool is used to measure the thickness of a material layer being polished on each of successive wafers in a lot prior to the final polishing step, in order to precisely polish the layer to a desired target thickness at the final polishing step. This renders unnecessary an additional process cycle to polish the layer on each wafer to the desired target thickness. The metrology tool may be modularized as a unit with the polishing pads or belts.

11 Claims, 3 Drawing Sheets

CMP APPARATUS AND PROCESS SEQUENCE METHOD

CROSS-REFERENCE TO RELATED APPLICATION

This application is a division of U.S. patent application Ser. No. 10/788,702, filed Feb. 27, 2004, now U.S. Pat. No. 7,118,451 .

FIELD OF THE INVENTION

The present invention relates to chemical mechanical polishing apparatus for polishing semiconductor wafer substrates. More particularly, the present invention relates to a new and improved CMP apparatus and process sequence method which includes the integration of CMP metrology between polishing steps to expedite polishing of multiple wafers.

BACKGROUND OF THE INVENTION

In the fabrication of semiconductor devices from a silicon wafer, a variety of semiconductor processing equipment and tools are utilized. One of these processing tools is used for polishing thin, flat semiconductor wafers to obtain a planarized surface. A planarized surface is highly desirable on a shallow trench isolation (STI) layer, inter-layer dielectric (ILD) or on an inter-metal dielectric (IMD) layer, which are frequently used in logic & memory devices. The planarization process is important since it enables the subsequent use of a high-resolution lithographic process to fabricate the next-level circuit. The accuracy of a high resolution lithographic process can be achieved only when the process is carried out on a substantially flat surface. The planarization process is therefore an important processing step in the fabrication of semiconductor devices.

A global planarization process can be carried out by a technique known as chemical mechanical polishing, or CMP. The process has been widely used on ILD or IMD layers in fabricating modern semiconductor devices. A CMP process is performed by using a rotating platen in combination with a polishing head. The process is used primarily for polishing the front surface or the device surface of a semiconductor wafer for achieving planarization and for preparation of the next level processing. A wafer is frequently planarized one or more times during a fabrication process in order for the top surface of the wafer to be as flat as possible. A wafer can be polished in a CMP apparatus by being placed on a carrier and pressed face down on a polishing pad covered with a slurry of colloidal silica, $CeO_2$ or aluminum.

A polishing pad used on a rotating platen is typically constructed in two layers overlying a platen, with a resilient layer as an outer layer of the pad. The layers are typically made of a polymeric material such as polyurethane and may include a filler for controlling the dimensional stability of the layers. A polishing pad is typically made several times the diameter of a wafer in a conventional rotary CMP, while the wafer is kept off-center on the pad in order to prevent polishing of a non-planar surface onto the wafer. The wafer itself is also rotated during the polishing process to prevent polishing of a tapered profile onto the wafer surface. The axis of rotation of the wafer and the axis of rotation of the pad are deliberately not collinear; however, the two axes must be parallel. It is known that uniformity in wafer polishing by a CMP process is a function of pressure, velocity and concentration of the slurry used.

A CMP process is frequently used in the planarization of an STI, ILD or IMD layer on a semiconductor device. Such layers are typically formed of a dielectric material. A most popular dielectric material for such usage is silicon oxide. In a process for polishing a dielectric layer, the goal is to remove typography and yet maintain good uniformity across the entire wafer. The amount of the dielectric material removed is normally between about 2000 A and about 20,000 A. The uniformity requirement for ILD or IMD polishing is very stringent since non-uniform dielectric films lead to poor lithography and resulting window-etching or plug-formation difficulties. The CMP process has also been applied to polishing metals, for instance, in tungsten plug formation and in embedded structures. A metal polishing process involves a polishing chemistry that is significantly different than that required for oxide polishing.

Important components used in CMP processes include an automated rotating polishing platen and a wafer holders which both exert a pressure on the wafer and rotate the wafer independently of the platen. The polishing or removal of surface layers is accomplished by a polishing slurry consisting mainly of fumed, colloidal silica or $CeO_2$ suspended in deionized water or alkali solution. The slurry is frequently fed by an automatic slurry feeding system in order to ensure uniform wetting of the polishing pad and proper delivery and recovery of the slurry. For a high-volume wafer fabrication process, automated wafer loading/unloading and a cassette handler are also included in a CMP apparatus.

As the name implies, a CMP process executes a microscopic action of polishing by both chemical and mechanical means. While the exact mechanism for material removal of an oxide layer is not known, it is hypothesized that the surface layer of silicon oxide is removed by a series of chemical reactions which involve the formation of hydrogen bonds with the oxide surface of both the wafer and the slurry particles in a hydrogenation reaction; the formation of hydrogen bonds between the wafer and the slurry; the formation of molecular bonds between the wafer and the slurry; and finally, the breaking of the oxide bond with the wafer or the slurry surface when the slurry particle moves away from the wafer surface. It is generally recognized that the CMP polishing process is not a mechanical abrasion process of slurry against a wafer surface.

While the CMP process provides a number of advantages over the traditional mechanical abrasion type polishing process, a serious drawback for the CMP process is the difficulty in controlling polishing rates at different locations on a wafer surface. Since the polishing rate applied to a wafer surface is generally proportional to the relative rotational velocity of the polishing pad, the polishing rate at a specific point on the wafer surface depends on the distance from the axis of rotation. In other words, the polishing rate obtained at the edge portion of the wafer that is closest to the rotational axis of the polishing pad is less than the polishing rate obtained at the opposite edge of the wafer. Even though this is compensated for by rotating the wafer surface during the polishing process such that a uniform average polishing rate can be obtained, the wafer surface, in general, is exposed to a variable polishing rate during the CMP process.

Recently, a chemical mechanical polishing method has been developed in which the polishing pad is not moved in a rotational manner but instead, in a linear manner. It is therefore named as a linear chemical mechanical polishing process, in which a polishing pad is moved in a linear manner in relation to a rotating wafer surface. The linear polishing method affords a more uniform polishing rate across a wafer surface throughout a planarization process for the removal of a film layer from the surface of a wafer. One added advantage of the linear CMP system is the simpler construction of the apparatus, and this not only reduces the cost of the apparatus but also reduces the floor space required in a clean room environment.

A typical conventional CMP apparatus 90 is shown in FIG. 1 and includes a base 100; polishing pads 210*a*, 210*b*, and 210*c* provided on the base 100; a head clean load/unload (HCLU) station 360 which includes a load cup 300 for the loading and unloading of wafers (not shown) onto and from, respectively, the polishing pads; and a head rotation unit 400 having multiple polishing heads 410*a*, 410*b*, 410*c* and 410*d* for holding and fixedly rotating the wafers on the polishing pads.

The three polishing pads 210*a*, 210*b* and 210*c* facilitate simultaneous processing of multiple wafers in a short time. Each of the polishing pads is mounted on a rotatable carousel (not shown). Pad conditioners 211*a*, 211*b* and 211*c* are typically provided on the base 100 and can be swept over the respective polishing pads for conditioning of the polishing pads. Slurry supply arms 212*a*, 212*b* and 212*c* are further provided on the base 100 for supplying slurry to the surfaces of the respective polishing pads.

The polishing heads 410*a*, 410*b*, 410*c* and 410*d* of the head rotation unit 400 are mounted on respective rotation shafts 420*a*, 420*b*, 420*c*, and 420*d* which are rotated by a driving mechanism (not shown) inside the frame 401 of the head rotation unit 400. The polishing heads hold respective wafers (not shown) and press the wafers against the top surfaces of the respective polishing pads 210*a*, 210*b* and 210*c*. In this manner, material layers are removed from the respective wafers. The head rotation unit 400 is supported on the base 100 by a rotary bearing 402 during the CMP process.

The load cup 300 is detailed in FIG. 1 and includes a pedestal support column 312 that supports a circular pedestal 310 on which the wafers are placed for loading of the wafers onto the polishing pads 210*a*, 210*b* and 210*c*, and unloading of the wafers from the polishing pads. A pedestal film 313 is typically provided on the upper surface of the pedestal 310 for contacting the patterned surface (the surface on which IC devices are fabricated) of each wafer. Fluid openings 314 extend through the pedestal 310 and pedestal film 313. The bottom surfaces of the polishing heads 410*a*, 410*b*, 410*c* and 410*d* and the top surface of the pedestal film 313 are washed at the load cup 300 by the ejection of washing fluid through the fluid openings 314.

In typical operation of the CMP apparatus 90, each wafer is mounted on a polishing head 410*a*, 410*b*, 410*c* or 410*d* and sequentially polished against the polishing pads 210*a*, 210*b* and 210*c*, respectively. This is shown in FIG. 2, wherein S1 indicates the first polishing step on the polishing pad 210*a*; S2 indicates the second polishing step on the polishing pad 210*b*; and S3 indicates the third polishing step on the polishing pad 210*c*. After polishing, the wafer may be subjected to cleaning, as indicated in step S4, followed by in-line metrology, as indicated in step S5.

The in-line metrology step (S5) frequently reveals that the polished wafers require additional polishing steps to remove additional material therefrom. Accordingly, many wafers subjected to CMP require a second series of polishing steps following the in-line metrology step. This fine polishing process is implemented according to the results of the metrology step to achieve a material layer target thickness that is optimal for further processing.

Although the actual material removal rate of the fine polishing process is about ⅙.about. ⅛ that of the first polishing process, the total process time is about the same as that of the first polishing process. This dual-processing of wafer lots substantially prolongs the process cycle time, reducing both equipment availability and process throughput. Accordingly, a CMP apparatus and process sequence method is needed which facilitates the in-line metrology of wafers prior to the third polishing step in a polishing process in order to obtain a material layer of target thickness without the need for an additional process cycle.

An object of the present invention is to provide a new and improved CMP apparatus in which a metrology tool is interposed between successive polishing pads in the apparatus.

Another object of the present invention is to provide a new and improved CMP apparatus in which a first metrology tool may be interposed between first and second polishing pads and a second metrology tool interposed between second and third polishing pads on the apparatus.

Still another object of the present invention is to provide a new and improved CMP apparatus and process sequence method which expedites the polishing of multiple wafers.

Yet another object of the present invention is to provide a new and improved CMP apparatus and process sequence method which substantially enhances wafer throughput in a CMP process.

A still further object of the present invention is to provide a CMP process sequence method according to which a wafer metrology step is interposed between successive polishing steps in a CNP process to facilitate optimal polishing of multiple wafers using a minimum number of polishing steps.

SUMMARY OF THE INVENTION

In accordance with these and other objects and advantages, the present invention is generally directed to a new and improved CMP apparatus which includes multiple polishing pads and an in-line metrology tool which is interposed between adjacent polishing pads in the apparatus. A material layer on each of multiple wafers is successively polished on the polishing pads. The metrology tool is used to measure the thickness of a material layer being polished on each of successive wafers in a lot prior to the final polishing step, in order to precisely polish the layer to a desired target thickness at the final polishing step. This renders unnecessary an additional process cycle to polish the layer on each wafer to the desired target thickness. The metrology tool may be modularized as a unit with the polishing pads.

The present invention is further directed to a new and improved CMP process sequence method. The method includes subjecting a material layer on each of multiple wafers to successive CMP polishing steps in a polishing cycle. Within the polishing cycle, each wafer is subjected to a metrology step to measure the thickness of the material layer, prior to subjecting the layer on each wafer to a final polishing step or steps. At the final polishing step or steps, the material layer is polished to a target thickness which is optimal to resume semiconductor processing.

In a typical embodiment, the CMP apparatus of the present invention includes a first polishing pad, a second polishing pad, a third polishing pad and an in-line metrology tool interposed between the second and third polishing pads. In typical application, a material layer on a wafer is subjected to a first polishing step on the first polishing pad; a second polishing step on the second polishing pad; and a metrology step in which the thickness of the material layer is measured. On the third polishing pad, the layer is subjected to a final polishing step in which the layer is polished to a desired target thickness.

In another embodiment, the metrology tool is interposed between the first polishing pad and the second polishing pad. The material layer on each of multiple wafers is then subjected to a first polishing step on the first polishing pad, a metrology step to measure the thickness of the layer, and to second and third polishing steps, respectively. In the second and third polishing steps, the layer is polished to the desired target thickness. The in-line metrology can provide not only the final fine polish desired amount but also to feed backward the optimal polish condition for prior polished step or steps of successive wafers by adjusting process time, pressure, head/platen rotation speed and slurry flow.

BRIEF DESCRIPTION OF THE DRAWINGS

The invention will now be described, by way of example, with reference to the accompanying drawings, in which.

DETAILED DESCRIPTION OF THE INVENTION

The present invention contemplates a new and improved CMP apparatus which includes multiple polishing pads and an in-line metrology tool which is interposed between adjacent polishing pads in the apparatus and may be modularized as a unit with the polishing pads. The CMP tool may include a base, multiple polishing pads provided on the base, a head rotation unit having multiple polishing heads provided above the polishing pads, a load/unload stage provided on the base for the loading and unloading of wafers to and from the polishing heads, and an in-line metrology tool interposed between two of the polishing pads on the base. The metrology tool is used to measure the thickness of a material layer being polished on each of successive wafers in a lot prior to the final polishing step or steps. This facilitates precise polishing of the layer to a desired target thickness at the final polishing step or steps and renders unnecessary an additional process cycle to polish the layer on each wafer to the desired target thickness.

The present invention is further directed to a new and improved CMP process sequence method. The method includes subjecting a material layer on each of multiple wafers to successive CMP polishing steps in a polishing cycle. Within the polishing cycle, each wafer is subjected to a metrology step to measure the thickness of the material layer, prior to subjecting the layer on each wafer to a final polishing step or steps. At the final polishing step or steps, the material layer is polished to a target thickness which is optimal to resume semiconductor processing.

Figure 1:
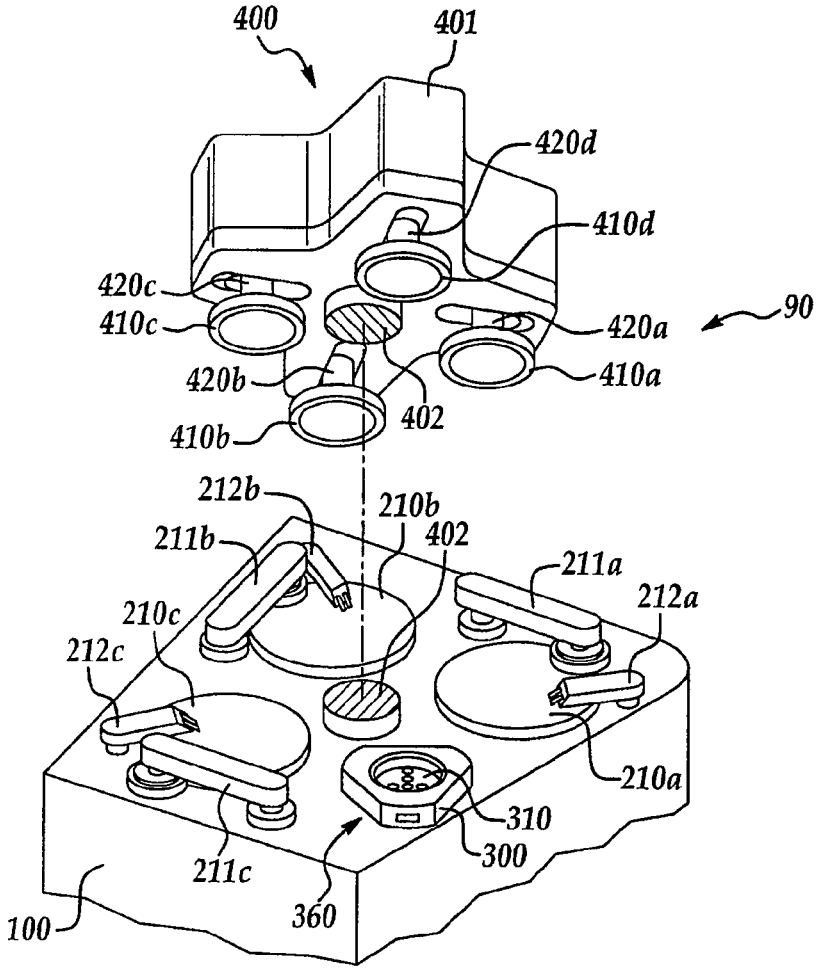
Figure 1 Prior Art
FIG. 1 is a perspective view of a typical conventional chemical mechanical polishing apparatus for the simultaneous polishing of multiple wafers.
Figure 1A:
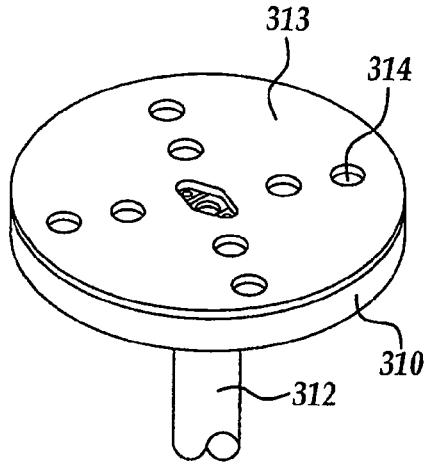
Figure 1A Prior Art
FIG. 1A is a top perspective view, partially in section, of a conventional pedestal assembly of the CMP apparatus of FIG. 1.
Figure 2:
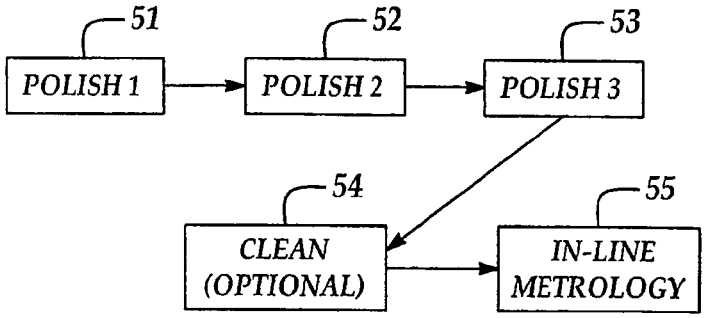
Figure 2 Prior Art
FIG. 2 is a flow diagram illustrating sequential process steps according to a typical conventional CMP process.
Figure 3:
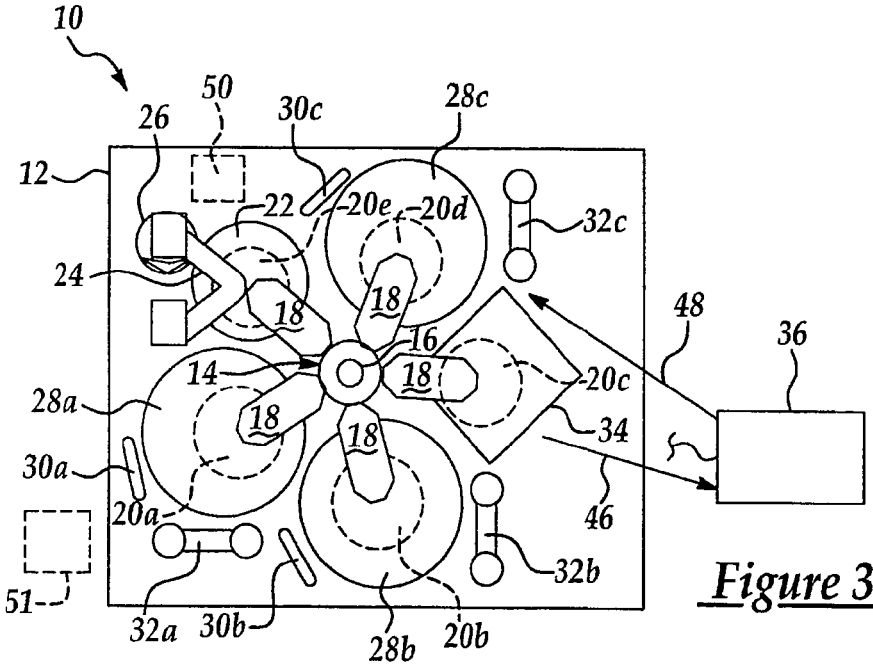
FIG. 3 is a top view of a CMP apparatus according to the present invention.

Referring to FIG. 3, an illustrative embodiment of a CMP apparatus according to the present invention is generally indicated by reference numeral 10. The CMP apparatus 10 includes a base 12 on which is provided a load/unload station 22 that receives a wafer 26 from a robot 24. A first polishing pad 28*a*, a second polishing pad 28*b* and a third polishing pad 28*c* are provided on respective polishing platens (not shown) rotatably mounted on the base 12 for sequential polishing of the wafer 26, as hereinafter described. A head rotation unit 14, typically suspended above the base 12 on a shaft 16, includes multiple, outwardly-extending arms 18. Polishing heads 20*a*-20*e* are provided on the respective arms 18.

Slurry dispensing arms 30*a*-30*c* are typically provided on the base 12, adjacent to the respective polishing pads 28*a*-28*c*. The slurry dispensing arms 30*a*-30*c* dispense slurry (not shown) onto the respective polishing pads 28*a*-28*c* during sequential polishing of each wafer 26, as hereinafter further described. Pad conditioners 32*a*-32*c* are typically further provided on the base 12 for the conditioning of the respective polishing pads 28*a*-28*c*, as is known by those skilled in the art.

An in-line metrology tool 34 is provided on the base 12, between the second polishing pad 28*b* and the third polishing pad 28*c*. The in-line metrology tool 34 may be any type of metrology tool known by those skilled in the art which is used to measure the thickness of a material layer (not shown) on each wafer 26. A CLC process controller 36 is operably connected to the functional components, such as the head rotation unit 14 and the polishing pads 28*a*-28*c*, of the CMP apparatus 10 in order to control automated transfer of a wafer 26, mounted on one of the polishing heads 20*a*-20*e*, among the polishing pads 28*a*-28*c* and the metrology tool 34 in the polishing sequence, as hereinafter further described. The process controller 36 also controls the polishing time of the wafer 26 at each polishing step on the respective polishing pads 28*a*-28*c*. The in-line metrology tool 34 is operably connected to the process controller 36 and actuates the process controller 36 to modify or adjust the polishing time for the wafer 26 at the final polishing step on the third polishing pad 20*c*, as needed, in order to obtain a desired target thickness of the material layer being polished on the wafer 26. The metrology tool 34 may be modularized as a unit with the first polishing pad 28*a*, the second polishing pad 28*b*, the third polishing pad 38*c* and the process controller 36. An in-situ polish clean tool 50 may be modularized as a unit with the CMP apparatus 10 for cleaning the wafers 26 after the CMP process. Alternatively, an ex-situ polish clean tool 51, which is separate from the CMP apparatus 10, may be provided for cleaning the wafers 26.

Figure 3A:
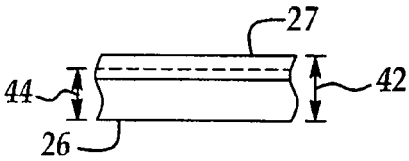
FIG. 3*a* is a cross-sectional view of a wafer with a material layer deposited thereon.

Referring next to FIG. 3A, the CMP apparatus 10 is used to polish and reduce the thickness of a material layer 27 previously deposited on a wafer 26. Throughout the CMP polishing process, the material layer 27 is reduced from a pre-CMP thickness 42, to a target thickness 44. Typically, the material layer 27 includes a metal layer on which is provided a dielectric layer. For example, the metal layer may be tungsten, copper or aluminum, or alloys of those metals, with an oxide dielectric layer provided thereon. The metal layer and the dielectric layer may be deposited on the wafer 26 using techniques such as PVD (physical vapor deposition), CVD (chemical vapor deposition) or ECP (electric chemical plating), for example. Alternatively, the entire material layer 27 may be a dielectric layers as in STI application.

The CMP process may be carried out during the fabrication of trenches in a dielectric layer or in a metal layer, for example. After the material layer 27 is deposited on the wafer 26, the pre-CMP thickness 42 of the material layer 27 is typically greater than the target thickness 44, which is required for the fabrication of trenches in the material layer 27. In the event that the material layer 27 is a dielectric layer, the target thickness 44 of the material layer 42 may be from typically about 300 angstroms to about 20,000 angstroms, which corresponds to the dielectric trench depth. Alternatively, the CMP process may be carried out during the fabrication of STI (shallow trench isolation) structures in a metal layer, in which case the trench depth, and thus the target thickness 44, of the metal material layer 27 is from typically about 500 angstroms to about 5 .mu.m.

Figure 5:
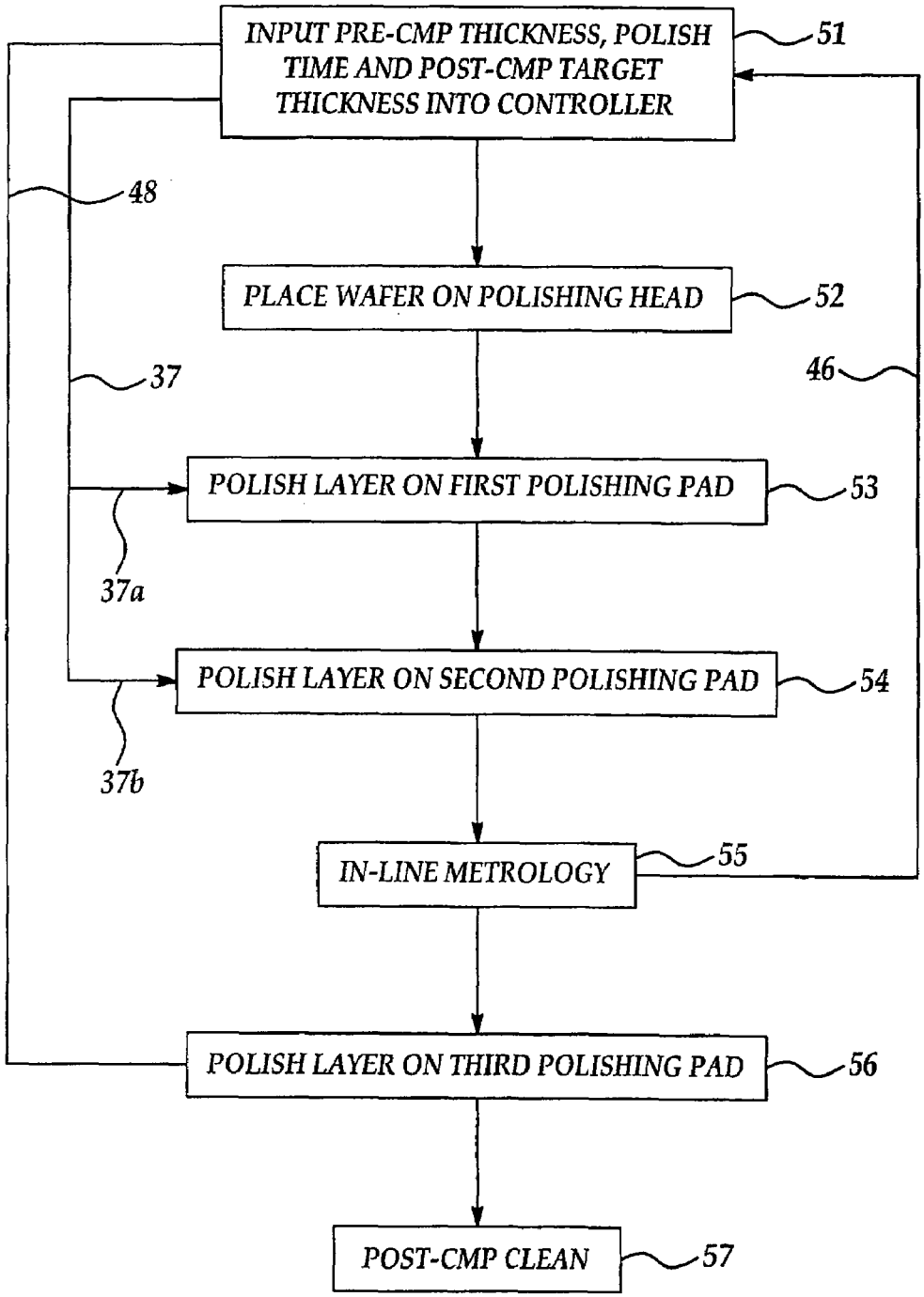
FIG. 5 is a flow diagram illustrating sequential process steps according to a process sequence method of the present invention.

Referring next to FIGS. 3 and 5, in operation of the CMP apparatus 10, the pre-CMP thickness 42 and the target thickness 44 of the material layer 27 (FIG. 3A), as well as the total polish time estimated for polishing the material layer 27 down to the target thickness 44, are initially programmed into the process controller 36, as indicated in process step S1 of FIG. 5. Next, each of multiple wafers 26 in a lot is individually and sequentially transferred from a wafer cassette (not shown), onto the load/unload station 22, typically by operation of the robot 24. From the load/unload station 22, each wafer 26 is sequentially placed on one of the polishing heads 20*a*-20*d*, as indicated in process step S2.

After a wafer 26 is placed on one of the polishing heads 20*a*-20*d*, the head rotation unit 14 rotates the polishing head to the first polishing pad 28*a*. In a first polishing step, the polishing head then rotates the wafer 26 while pressing the material layer 27 against the first polishing pad 28*a*, as indicated in step S3. Accordingly, the process controller 36 transmits process signals 37 and 37*a* to the CMP apparatus 10, as shown in FIG. 3. The head rotation unit 14, in turn, causes the polishing head to rotate the material layer 27 against the first polishing pad 28*a* for a time which depends on the estimated total polish time, the pre-CMP thickness 42 and the target thickness 44 of the material layer 27. The first polishing step is typically a course polishing step. Depending on the application, the course removal thickness may vary from 0-20,000 angstroms and the removal process is divided among two or more platens. The course polishing step may remove the cap layer only without contacting the underlying layer (0 angstroms), as in typical dual damascene applications. In other cases, the course polishing step may remove the cap layer in addition to underlying layer or layers, up to a depth of typically about 20,000 angstroms, such as in an IMD process.

After the first polishing step is completed, the head rotation unit 14 rotates the wafer 26 from the first polishing pad 28*a* to the second polishing pad 28*b* and rotates the material layer 27 against the second polishing pad 28*b* in a second polishing step, as indicated in step S4. The process controller 36 transmits a process signal 37*b* to the CMP apparatus 10, as shown in FIG. 3. The head rotation unit 14 causes the polishing head to rotate the material layer 27 against the second polishing pad 28*b* for a time which depends on the estimated total polish time remaining, the pre-CMP thickness 42 and the target thickness 44 of the material layer 27 previously programmed into the process controller 36 at process step S1. Like the first polishing step, the second polishing step is typically a course polishing step in which material is removed from the material layer 27. Depending on the application, the course removal thickness may vary from 0-20,000 angstroms and the removal process is divided among two or more platens. The course polishing step may remove the cap layer only without contacting the underlying layer (0 angstroms), as in typical dual damascene applications. In other cases, the course polishing step may remove the cap layer in addition to underlying layer or layers, up to a depth of typically about 20,000 angstroms, such as in an IMD process.

After the second polishing step is completed, the head rotation unit 14 transfers the wafer 26 from the second polishing pad 28*b* to the in-line metrology tool 34. As indicated in step S5, at the in-line metrology tool 34, the thickness of the material layer 27 is measured. Other parameters, such as film density and sheet resistance ($R_S$), may also be measured. As shown in FIGS. 3 and 5, the metrology tool 34 transmits a feedback signal 46, which corresponds to the measured thickness of the material layer 27, to the process controller 36, in order to adjust the course polish conditions such as polish time, down force, platen/head rotation speed and slurry flow for the successive wafers. Based on the measured thickness of the material layer 27, as indicated through the feedback signal 46, the process controller 36 calculates the time required to polish the material layer 27 from the measured thickness to the intermediate target thickness 44, and transmits this information, through an adjustment signal 48, to the first and second polishing pads 28*a*, 28*b*, respectively, of the CMP apparatus 10 for the successive wafers to minimize the fine polish variation.

On the other hand, based on the measured thickness of the material layer 27, as indicated through the feedback signal 46, the process controller 36 calculates the time required to polish the material layer 27 from the measured thickness to the target thickness 44, and transmits this information, through an adjustment signal 48, to the third polishing pad 28*c* of the CMP apparatus 10. As indicated in process step S6, the third polishing pad 28*c* then polishes the material layer 27 from the measured thickness down to the target thickness 44, according to the calculated polishing time transmitted through the adjustment signal 48. Finally, the post-CMP thickness of the material layer 27 may then be measured to verify the target thickness before or after cleaning. As indicated in step S7, the wafer 26 may be subjected to a post-CMP cleaning process to remove particles remaining on the wafer 26, prior to continued semiconductor fabrication. This is carried out using the in-situ polish clean tool 50, or alternatively, the ex-situ polish clean tool 51. In the event that the measured post-CMP thickness deviates from the target thickness, the wafer 26 may be re-worked and subjected to another polishing and measuring cycle through the CMP apparatus 10.

As a first wafer 26 is polished on the first polishing pad 28*a*, a second wafer 26 is loaded onto the load/unload station 22. The first wafer 26 is then transferred to and polished on the second polishing pad 28*b*, while the second wafer 26 is transferred to and polished on the first polishing pad 28*a* and a third wafer 26 is transferred to the load/unload station 22. The first wafer 26 is subjected to metrology at the metrology tool 34 while the second wafer 26 is polished at the second polishing pad 28*b* and the third wafer 26 is polished at the first polishing pad 28*a*. The first wafer 26 is subjected to the final polishing step at the third polishing pad 28*c* while the second wafer 26 undergoes metrology at the metrology tool 34 and the third wafer 26 is polished at the second polishing pad 28*b*. Accordingly, multiple wafers 26 in a lot are sequentially polished throughout the polishing sequence.

Figure 4:
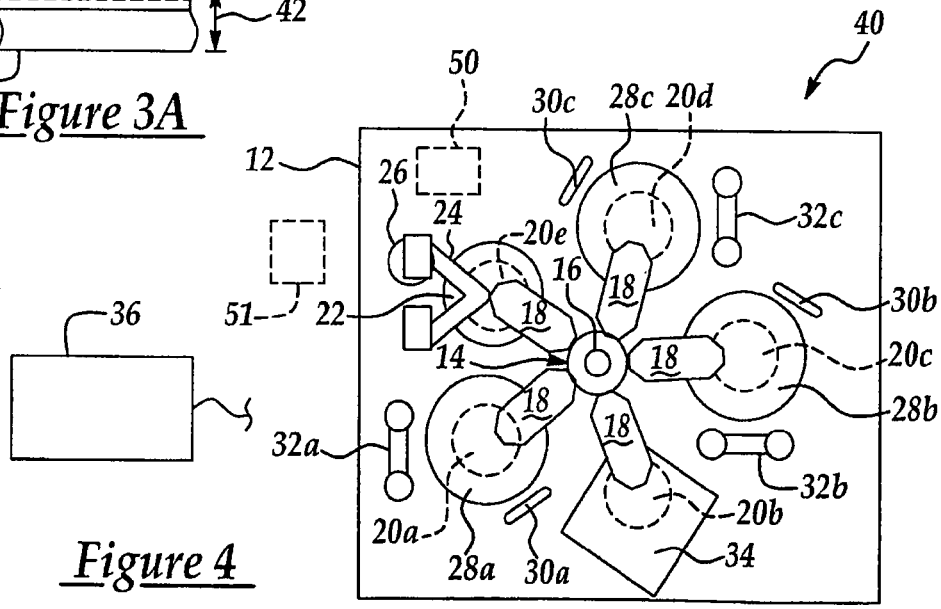
FIG. 4 is a top view of another embodiment of a CMP apparatus according to the present invention.

Referring next to FIG. 4, in an alternative embodiment of the CMP apparatus of the present invention, generally indicated by reference numeral 40, the in-line metrology tool 34 is positioned between the first polishing pad 28*a* and the second polishing pad 28*b* on the base 12. After each wafer 26 is polished on the first polishing pad 28*a*, the wafer 26 is transferred to the metrology tool 34, which measures the thickness of the material layer 27 thereon. This measured thickness is used by the process controller 36 to calculate the polishing time remaining at the second and third polishing steps, on the second polishing pad 28*b* and third polishing pad 28*c*, respectively, to obtain the target thickness 44 of the material layer 27.

While the preferred embodiments of the invention have been described above, it will be recognized and understood that various modifications can be made in the invention and the appended claims are intended to cover all such modifications which may fall within the spirit and scope of the invention.

What is claimed is:

1. A method of polishing a layer on a wafer, comprising the steps of:

providing a plurality of polishing pads or belts for polishing the layer and a metrology tool between a pair of adjacent ones of said plurality of polishing pads or belts for measuring a thickness of the layer;

polishing the layer on at least a first one of said plurality of polishing pads or belts;

measuring the thickness of the layer by operation of said metrology tool; and polishing the layer to a target thickness on at least a second one of said plurality of polishing pads or belts.

2. The method of claim 1 wherein:

said plurality of polishing pads or belts comprises first, second and third polishing pads or belts;

said metrology tool is interposed between said second polishing pad or belt and said third polishing pad or belt;

said polishing the layer on at least a first one of said plurality of polishing pads or belts comprises polishing the layer on said first polishing pad or belt and said second polishing pad or belt; and said polishing the layer to a target thickness on at least a second one of said plurality of polishing pads or belts comprises polishing the layer to a target thickness on said third polishing pad or belt.

3. The method of claim 1 wherein:

said plurality of polishing pads or belts comprises first, second and third polishing pads or belts;

said metrology tool is interposed between said first polishing pad and said second polishing pad;

said polishing the layer on at least a first one of said plurality of polishing pads or belts comprises polishing the layer on said first polishing pad or belt; and said polishing the layer to a target thickness on at least a second one of said plurality of polishing pads or belts comprises polishing the layer to a target thickness on said second polishing pad or belt and said third polishing pad or belt.

4. The method of claim 1 wherein said layer is a dielectric material and said target thickness is from about 300 to about 20,000 angstroms.

5. The method of claim 1 wherein said layer is a metal layer and said target thickness is from about 500 angstroms to about 5 .mu.m.

6. The method of claim 1 further comprising the step of subjecting the wafer to a post-CMP clean process using an in-situ polish clean tool.

7. The method of claim 1 further comprising the step of subjecting the wafer to a post-CMP clean process using an ex-situ polish clean tool.

8. The method of claim 1 further comprising a controller connected to said plurality of polishing pads or belts and said metrology tool, and further comprising the steps of transmitting a feedback signal corresponding to the thickness of the layer from said metrology tool to said controller and an adjustment signal from said controller to said at least a second one of said plurality of polishing pads or belts, wherein said at least a second one of said plurality of polishing pads or belts polishes said layer to said target thickness according to said adjustment signal.

9. The method of claim 1 further comprising a controller connected to said plurality of polishing pads or belts and said metrology tool, and further comprising the steps of transmitting a feedback signal corresponding to the thickness of the layer from said metrology tool to said controller and an adjustment signal from said controller to said at least a first one of said plurality of polishing pads or belts, wherein said at least a first one of said plurality of polishing pads or belts polishes said layer to said intermediate target thickness according to said adjustment signal.

10. The method of claim 1 further comprising the steps of providing a plurality of wafers having a plurality of layers, respectively; and sequentially polishing the plurality of layers on said at least a first one of said plurality of polishing pads or belts, measuring the thicknesses of said plurality of layers, respectively, by operation of said metrology tool, and polishing the plurality of layers to a target thickness on said at least a second one of said plurality of polishing pads or belts, respectively.

11. The method of claim 1 further comprising the step of verifying said target thickness of the layer by subjecting the layer to a post-CMP thickness measurement.

* * * * *